US005277610A

United States Patent [19]

Krehbiel et al.

[11] Patent Number: 5,277,610

[45] Date of Patent: Jan. 11, 1994

[54] SEALING SYSTEM FOR ELECTRICAL CONNECTORS

[75] Inventors: Fred L. Krehbiel, Chicago; Edward J. Plocek; Stephen A. Colleran, both of Lisle; Burke J. Crane, Lombard; Duane M. Fencl, Countryside, all of Ill.

[73] Assignee: Molex Incorporated, Lisle, Ill.

[21] Appl. No.: 994,006

[22] Filed: Dec. 21, 1992

[51] Int. Cl.[5] ..... H01R 13/00

[52] U.S. Cl. ..... 439/271

[58] Field of Search ..... 439/271-439/283

[56] References Cited

U.S. PATENT DOCUMENTS 5,080,601 1/1992 Mennekes et al. ..... 439/271

5,100,335 3/1992 Yamamoto ..... 439/271

*Primary Examiner*—Joseph H. McGlynn

*Attorney, Agent, or Firm*—A. A. Tirva

[57] ABSTRACT

A sealing system is provided between an electrical connector assembly and another connector component, panel or the like. The connector assembly includes a housing having a mating end with a seal-receiving channel and a resilient seal received in the channel. The seal includes a sealing groove having a given width and a given depth. The connector component includes a sealing lip insertable into the sealing groove when the connector assembly and the connector component are mated along a mating axis. The sealing lip has a width greater than the width of the sealing groove and a length relative to the depth of the sealing groove such that the lip is spaced from the bottom of the groove when the connector assembly and the connector component are in mated condition. Therefore, only sealing forces normal to the mating axis are effected between the sealing lip and the sealing groove. A radio frequency seal is provided by point contacts between an edge of a flange of the connector assembly engaging an abutment surface of the connector component, the flange being overlapped with the sealing lip and another flange of the connector component, whereby a labyrinth path is defined through an interface area including the point contacts.

9 Claims, 3 Drawing Sheets

SEALING SYSTEM FOR ELECTRICAL CONNECTORS

FIELD OF THE INVENTION

This invention generally relates to the art of electrical connectors and, particularly, to a system for sealing electrical connectors, such as in adverse environments.

BACKGROUND OF THE INVENTION

Sealed electrical connector assemblies are used in a wide variety of applications wherein the assemblies are subjected to a wide range of environmental conditions and physical abuse. For example, one such application is where electrical connectors are mounted in the engine compartment of an automobile or other vehicle, although the invention is not limited to such an application.

In automotive applications, electrical connectors are incorporated into circuits that monitor and/or control a variety of vital vehicular functions. For example, steering, suspension and engine operating conditions continuously are monitored in many vehicles. Signals corresponding to sensed operating conditions may be transmitted to displays in the passenger compartment to enable the driver to take appropriate action in response to the displayed information. Other sensed conditions are monitored by controls which automatically alter some aspect of the vehicular performance to compensate for the sensed conditions. The electronic circuitry also extends into other nonessential aspects of the vehicle performance, including climate control, sound systems and the like.

Electrical connectors incorporated into the circuitry of an automotive vehicle are subjected to extreme environmental conditions, including broad ranges of temperature, exposure to moisture, subjection to almost continuous vibration during use and frequent subjection to direct physical shock. The connectors are exposed to soil and are frequently splashed with water, lubricants and fuels. In addition to practically continuous subjection to vibrations during use, the connectors frequently are subjected to sharp jarring movement as the vehicle traverses a rough road, and the connectors often are directly contacted by maintenance personnel working in the engine compartment.

Even aside from exposure to adverse conditions, such as in automotive applications as described above, mating electrical components have a tendency to "creep", bow and distort under pressure over a period of time, particularly at elevated temperatures. When a pair of electrical components are sealed in mated condition, this causes the seals to lose their effectiveness.

Heretofore, electrical connector seals typically have been positioned in channels located in one connector half or component, surrounding the connecting interface, with the seals engaged by portions of a housing of a mating component or panel. The seals are placed in a compressive state by forces applied parallel to the mating axis as well as normal to the mating axis. The seals are maintained in compressive state by latches or locks interengaged between the mating components. While the seals are initially effective, problems arise over time due to the adverse environmental conditions of the connectors as well as when creeping sets in, whereby the sealing forces acting on the seals parallel to the mating axis decrease. The sealing force may decrease to such a point where the seals no longer are effective to protect the connecting interface from moisture and other contaminants. This invention is directed to an improved environmental seal to solve these problems.

Another problem with electrical connectors of the character described, including automotive applications, is that the electrical circuitry often must be protected from disruptions or "noise" caused by electromagnetic interference, radio frequency interference, electrostatic discharges and/or electromagnetic pulses. In automotive applications, electronic circuitry, including computer circuitry, have become common to control, monitor or otherwise interconnect all kinds of electrical circuitry within the operative system of the vehicle, as described generally above. Therefore, not only do such electrical connectors have to be sealed against moisture and other contaminants, but the connector assemblies must be provided with filtering and shielding capabilities, such as to suppress electromagnetic interference and radio frequency interference, as well as transient suppression of electrostatic discharges and/or electromagnetic pulses. This invention also is directed to an improved interface between a pair of mating electrical components to isolate the components on either side of the connecting interface against electromagnetic interference, radio frequency interference and the like.

SUMMARY OF THE INVENTION

An object, therefore, of the invention is to provide a new and improved environmental sealing system between an electrical connector assembly and another connector component, panel, case or the like.

Another object of the invention is to provide a new and improved electrical grounding interface between a pair of connector components to protect against radio frequency interference and the like.

In the exemplary embodiment of the invention, generally, an electrical connector assembly includes a housing having a mating end with a seal-receiving channel, and a resilient seal received in the channel substantially surrounding the mating end of the assembly. The seal includes a sealing groove having a given width and a given depth. The assembly is mateable along a mating axis with another connector component, such as within an aperture in a panel, the connector component including a peripheral sealing lip insertable into the sealing groove when the connector assembly and the connector component are mated along the mating axis.

The invention contemplates that the sealing lip have a width greater than the width of the sealing groove and a length relative to the depth of the sealing groove such that the lip is spaced from the bottom of the groove when the connector assembly and the connector component are in mated condition. Therefore, only sealing forces normal to the mating axis are effected between the sealing lip and the sealing groove. Consequently, as the connector assembly and connector component tend to loosen or separate because of environmental conditions, or as they tend to creep, bow or distort over time, the seal is maintained effective since there are no compressive sealing forces in the direction of the mating axis.

Another feature of the invention is the provision of complementary interengaging abutment surfaces between the connector assembly and the connector component to limit the extent of insertion of the sealing lip into the sealing groove such that the lip remains spaced from the bottom of the groove when the connector assembly and the connector component are in mated condition. The invention contemplates that the abutment surfaces be of conductive material and include a pattern of point contacts to define a radio frequency seal therebetween. The complementary interengaging abutment surfaces extend substantially entirely about the mating interface of the connector assembly and the mating connector component.

Additionally, the point contacts deform during mating to absorb variations in flatness of the mating surfaces and assure electrical contact between the surfaces. The point contacts also determine where contact between the two surfaces will be made ensuring that no large conductive gaps will be formed, which would allow EMI/RFR signals of a certain frequency to penetrate the electrical shielding seal.

Still further, the invention contemplates the provision of a labyrinth path through the mating interface, including the radio frequency seal, to enhance the interference protection capabilities thereof. Specifically, the environmental sealing lip is defined by a first peripheral flange projecting from the connector component toward the connector assembly, and the complementary interengaging abutment surfaces include a second peripheral flange projecting from the connector assembly toward the connector component. The lip is located on one side of the second peripheral flange, and the connector component includes a third peripheral flange projecting therefrom toward the connector assembly on an opposite side of the second peripheral flanges. The flanges and the lip overlap each other normal to the mating axis to define a labyrinth path to enhance protection against radio frequency interference and the like.

The labyrinth is a redundant signal attenuation feature which dramatically increases the path length for EMI/RFI signals trying to transit across the interface.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
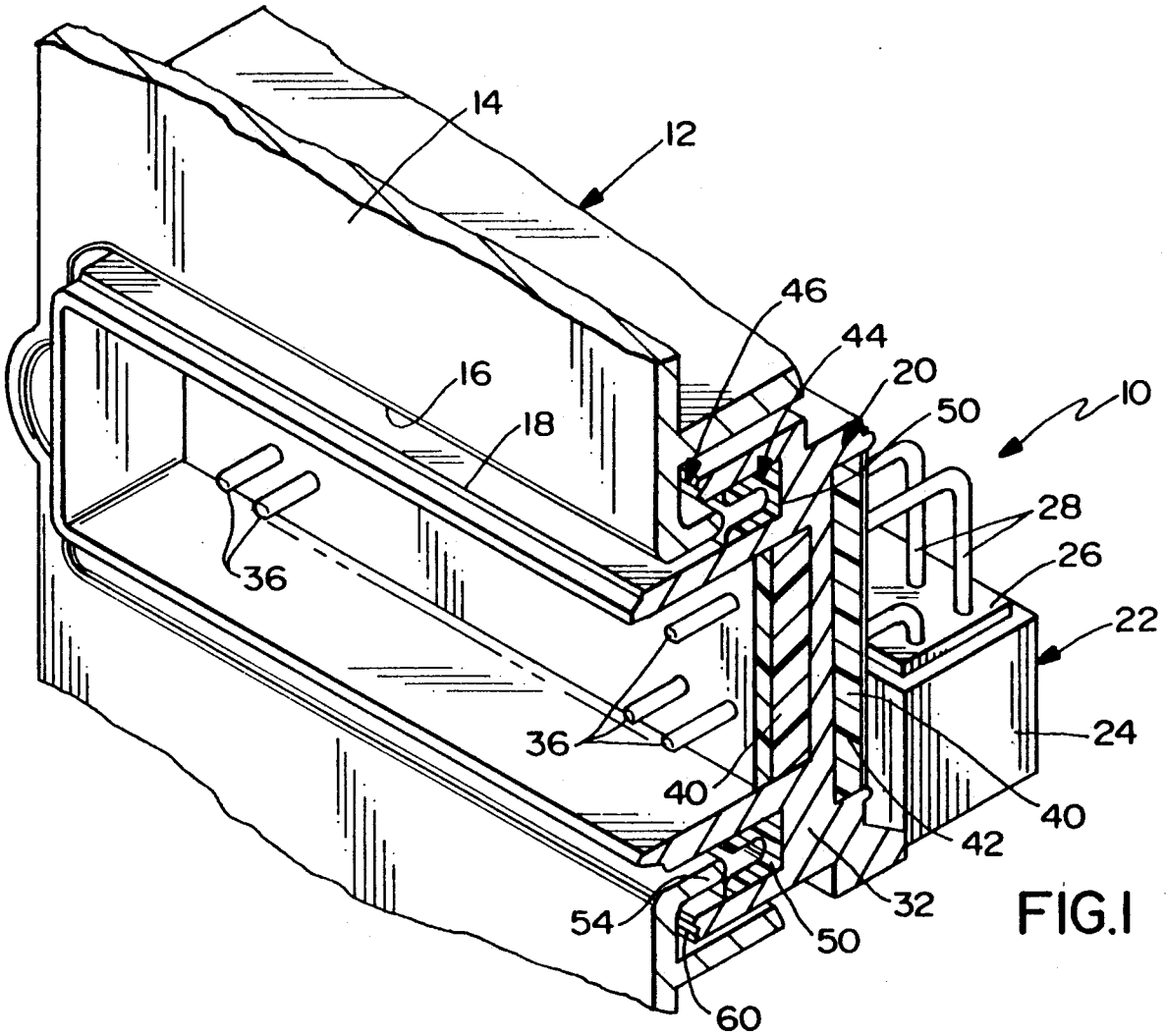
FIG. 1 is a fragmented perspective view of an electrical connector assembly incorporating the environmental sealing system and EMF/RFI of the invention.
Figure 2:
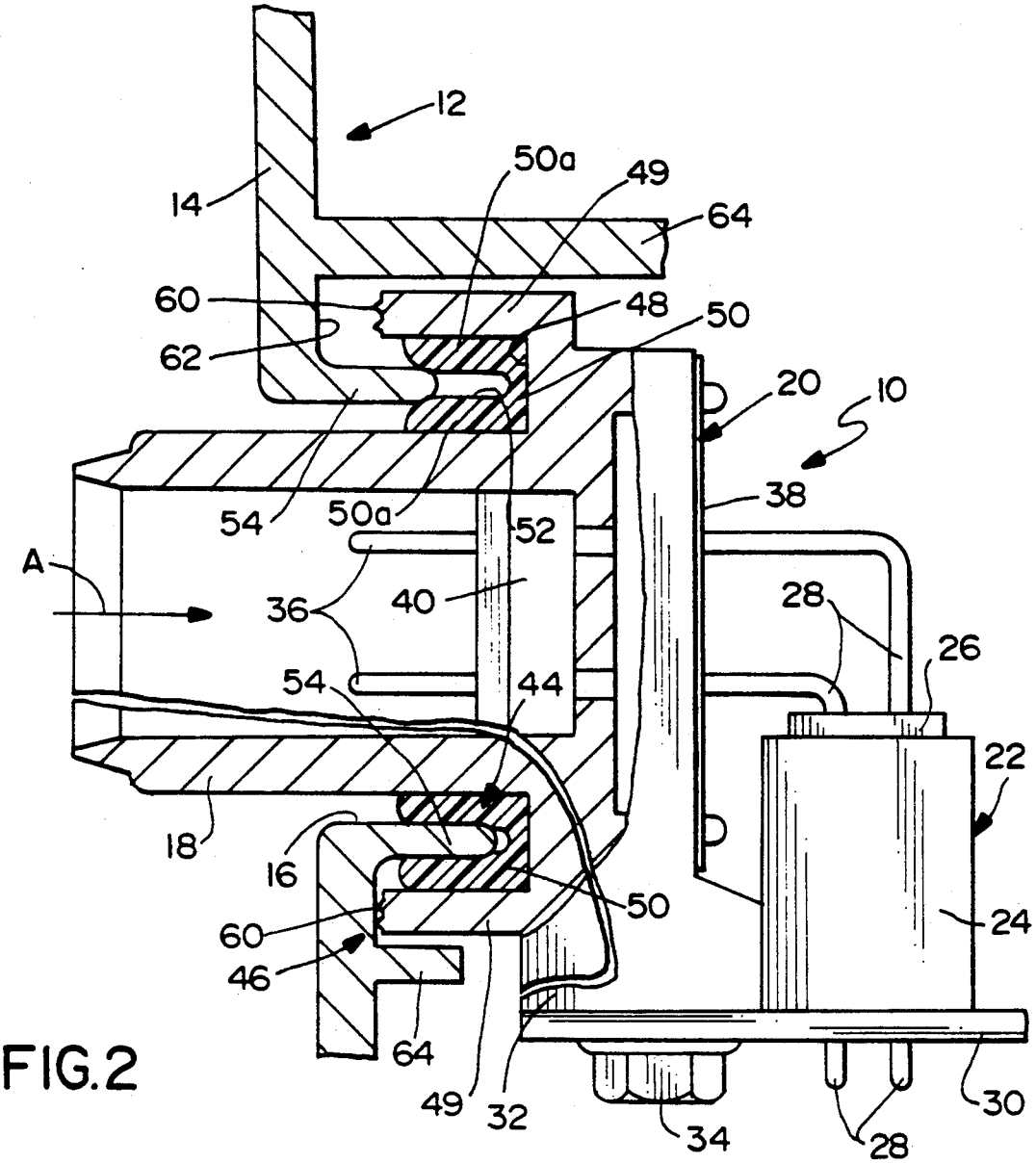
FIG. 2 is a vertical section, on an enlarged scale, through the assembly of FIG. 1, the illustration being split to show the sealing system in inoperative and operative conditions.

Referring to the drawings in greater detail, and first to FIGS. 1 and 2, the invention is incorporated in an electrical connector system which includes a multi-terminal filtered connector assembly, generally designated 10, which is mateable with another component, generally designated 12. As disclosed herein, connector component 12 actually is a panel 14 having an elongate opening 16 through which a mating end 18 of connector assembly 10 is inserted.

Connector assembly 10 is of the type shown in copending application Ser. No. 962,763, filed Oct. 19, 1992, assigned to the assignee of this invention and which is incorporated herein by reference. Suffice it to say herein, connector assembly 10 includes a main connector, generally designated 20, and a subassembly, generally designated 22. The subassembly includes a housing 24 which mounts a ferrite filter block 26 through which tails 28 of a plurality of terminals project for insertion into appropriate holes in a printed circuit board 30 (FIG. 2), whereby the terminals tails are soldered to appropriate circuit traces on the board or in the holes.

Main connector 20 includes a die cast housing 32 mounted to printed circuit board 30 by appropriate fastening means 34 (FIG. 2). The terminals have contact pins 36 projecting into mating end 18 of the connector assembly, whereby the contact pins are engageable with complementary terminals (not shown) of an appropriate mating electrical connector inserted into mating end 18 in the direction of arrow "A". The contact pins of the terminals project through a flexible capacitor filter circuit 38 mounted to the back side of housing 32. The contact pins also project through a pair of seal blocks 40 (FIG. 1) which sandwich a base wall 42 of housing 32. Other general characteristics of connector assembly 10 can be derived from the aforesaid copending application which, as stated, is incorporated herein by reference.

The invention herein is directed to a sealing system between connector assembly 10 and connector component 12 (panel 14) and which includes an environmental seal, generally designated 44, along with a radio frequency seal, generally designated 46. More particularly, referring to FIGS. 3 and 4 in conjunction with FIGS. 1 and 2, environmental seal 44 is provided by a seal-receiving channel 48 in housing 32, the channel being defined by mating end 18 and a forwardly projecting peripheral flange 49 of the housing. A resilient seal 50 is disposed within channel 48. The seal is generally U-shaped in cross-section to define a pair of legs **50*a* which form a sealing groove 52 therebetween. The sealing groove has a given width and a given depth of desired dimensions. Groove 52 and seal 50 surround mating end 18** of the connector assembly.

Environmental seal 44 further includes a sealing lip 54 projecting rearwardly of panel 14 for insertion into sealing groove 52 along a mating axis which coincides with the mating direction "A" of main connector 20 with its complementary connector.

Figure 3:
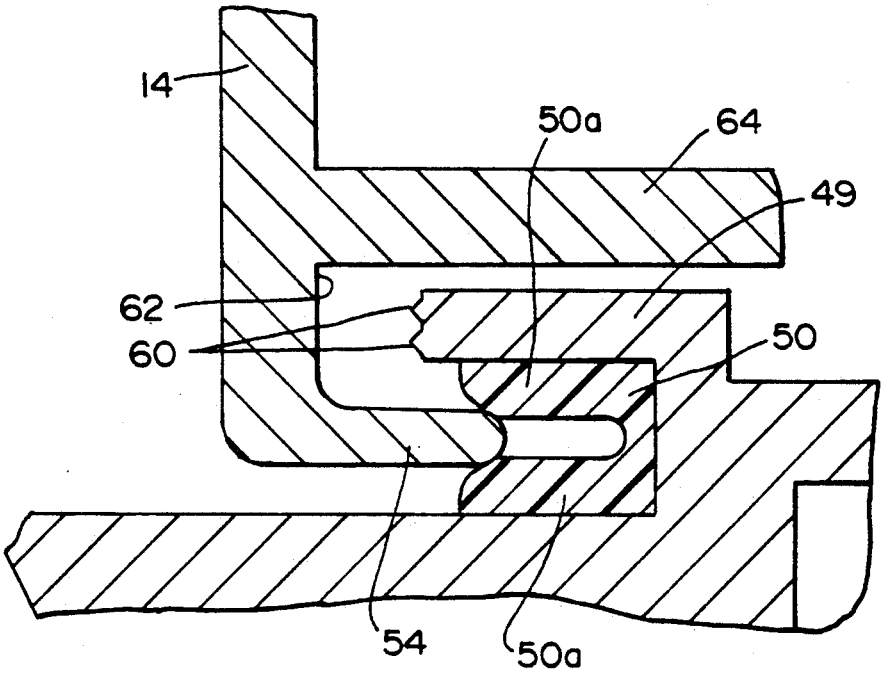
FIG. 3 is a section, on an enlarged scale, showing the environmental seal in unmated condition.

The upper half of FIG. 2 and FIG. 3 show sealing lip 54 about to be inserted into sealing groove 52 of seal 50. This is the unmated condition of the environmental seal corresponding to the unmated condition of connector assembly 10 with connector component 12 (i.e. panel 14). It can be seen that the width of sealing lip 54 is greater than the width of sealing groove 52.

Figure 4:
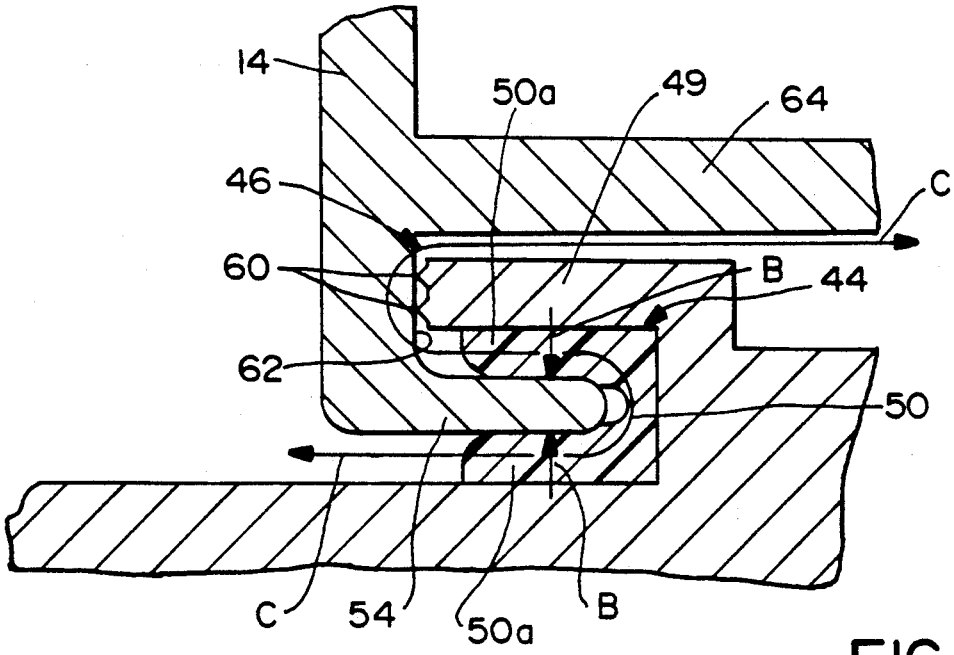
FIG. 4 is a sectional view similar to that of FIG. 3, with the environmental seal in mated condition.

The bottom of FIG. 2 and FIG. 4 show sealing lip 54 inserted into sealing groove 52 and, with particular reference to FIG. 4, it can be seen that the sealing lip has compressed legs 50*a* of seal 50 in a direction normal or perpendicular to the insertion direction of the sealing lip, i.e. normal to mating axis "A". It also can be seen that the sealing lip has a length relative to the depth of the sealing groove such that the distal edge of the sealing lip is spaced from the bottom of the groove in fully mated condition. As a result, only sealing forces normal to the mating axis are effected between sealing lip 54 and sealing groove 52, as represented by arrows "B" in FIG. 4.

With the construction and function of environmental seal 44, as particularly described in relation to the depiction of FIG. 4, it can be understood that should connector assembly 10 and connector component 12 (panel 14) creep, bow or distort under pressure, temperature or vibration conditions, the environmental seal afforded by the interengagement between sealing lip 54 and sealing groove 52 is not affected because there are no sealing forces parallel to the mating axis of the components. If the sealing lip were to bottom out in the sealing groove and the prescribed seal afforded by such a sealing means be relied upon, even the slightest creep between the interconnected components would cause the axially compressive sealing forces to lose their effectiveness. This could occur at any point surrounding the mating interface (i.e. mating end 18) of the connector assembly due to bowing or distortion of housing 32. With environmental seal 44 of the invention, which relies exclusively on sealing forces normal to the mating axis, the sealing function remains effective throughout a wide range of creeping, bowing or distortion of the connector assembly, particularly its elongated housing.

Figure 5:
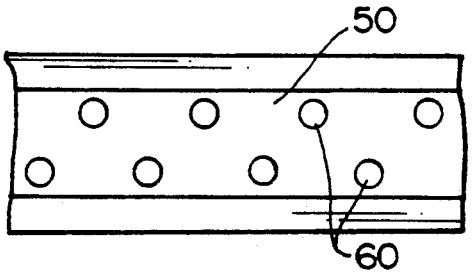
FIG. 5 is a plan view of the pointed interengaging surface on the connector assembly housing.
Figure 6:
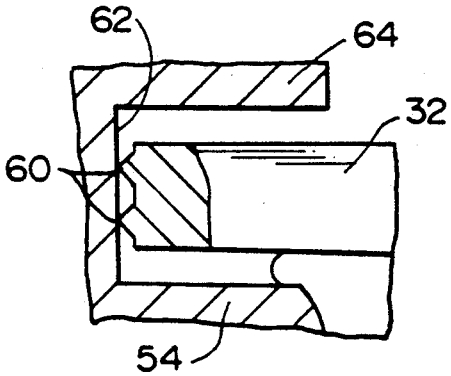
FIG. 6 is a section through the pointed interengaging surface in engagement with a surface of the panel.

Referring to FIGS. 5 and 6 in conjunction with FIGS. 1 and 2, radio frequency seal 46 is provided by a plurality of point contacts 60 formed along the entire distal edge of flange 50 of connector assembly housing 32. It can be seen in FIG. 5 that point contacts 60 are arranged in rows, with the point contacts in adjacent rows being offset or alternating lengthwise of the edge of flange 50. The point contacts are located for engagement with a surface area 62 on the back side of panel 14, between sealing lip 54 and a rearwardly projecting flange 64 of the panel.

The top half of FIG. 2 and FIG. 3 show point contacts 60 and surface area 62 out of engagement. This represents the unmated condition of the radio frequency seal. The bottom half of FIG. 2 and FIG. 4 show point contacts 60 in abutting engagement with surface area 62. This represents the mated condition of the radio frequency seal corresponding to the mated condition of connector assembly 10 and connector component 12 (panel 14). It is contemplated that the panel, like housing 32, be of a die cast material, such as a magnesium casting. Therefore, point contacts 60 establish positive commoning between the connector housing and the panel surrounding the mating end 18 of connector 20 which projects through aperture 16 in the panel.

The invention also contemplates the provision of a labyrinth path through radio frequency seal 44 (i.e. contact points 60) to enhance the protection capabilities of the seal against transmission therethrough of radio frequency or other interference waves. Specifically, referring to FIG. 4, it can be seen that flange 49 (which has contact points 60 along its distal edge) is located between sealing lip 54 and flange 64 which project rearwardly from panel 14. In other words, sealing lip 54, flange 50 and flange 64 all overlap each other normal to the mating axis of the components. In essence, it can be considered that point contacts 60 are "hidden" in a deadend location between sealing lip 54 and flange 64. Therefore, a labyrinth path c—c is provided to prevent direct interference waves from passing through the radio frequency seal. The interference waves must pass around flange 64, then around flange 50, and then around sealing lip 54 in order to flow through the interfacing area between electrical connector 20 and connector component 12 (panel 14) effectively increasing the aspect ratio of the mating interface..

The labyrinth is a redundant signal attenuation feature which dramatically increases the path length vs. the path width for EMI/RFI signals trying to transit across the interface.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a sealing system between an electrical connector assembly and another connector component, panel and the like, the connector assembly including a housing having a mating end with a seal-receiving channel and a resilient seal received in the channel, the seal including a sealing groove having a given width and a given depth, and the connector component including a sealing lip insertable into the sealing groove when the connector assembly and the connector component are mated along a mating axis, wherein the improvement comprises said sealing lip having a width greater than the width of the sealing groove and a length relative to the depth of the sealing groove such that the lip is spaced from the bottom of the groove when the connector assembly and the connector component are in mated condition, whereby only sealing forces normal to said mating axis are effected between the sealing lip and the sealing groove.

2. In a sealing system as set forth in claim 1, wherein said resilient seal is generally U-shaped in cross-section to define a pair of legs which form the sealing groove.

3. In a sealing system as set forth in claim 1, including complementary interengaging abutment means between the connector assembly and the connector component to limit the extent of insertion of the sealing lip into the sealing groove such that the lip remains spaced from the bottom of the groove when the connector assembly and the connector component are in mated condition.

4. In a sealing system as set forth in claim 3, wherein said complementary interengaging abutment means are of conductive material and include a pattern of point contacts to define a radio frequency seal therebetween.

5. In a sealing system as set forth in claim 4, wherein said complementary interengaging abutment means extend substantially entirely about the mating end of the housing of the connector assembly.

6. In a sealing system as set forth in claim 4, wherein said sealing lip is defined by a first peripheral flange projecting from the connector component toward the connector assembly, and said complementary interengaging abutment means include a second peripheral flange projecting from the connector assembly toward the connector component, the flanges overlapping each other normal to the mating axis to define a labyrinth path through an interface area including said radio frequency seal.

7. In a sealing system as set forth in claim 6, wherein said lip is located on one side of said second peripheral flange, and the connector component includes a third peripheral flange projecting from the connector component toward the connector assembly on an opposite side of the second peripheral flange.

8. A radio frequency sealing system between first and second electrical connector components mateable along a mating axis, comprising:

said first electrical component including a pair of flanges projecting generally parallel to the mating axis, the flanges being spaced normal to the axis to define an abutment surface therebetween; and said second electrical component including a flange projecting therefrom generally parallel to the mating axis and disposed between the pair of flanges of the first connector component, the distal edge of the flange of the second connector component including a plurality of point contacts for engaging the abutment surface of the first connector component when the connector components are in mated condition, whereby the flanges of the connector components define a labyrinth path through an interface area between the connector components including the interengagement of the point contacts with the abutment surface.

9. The radio frequency sealing system of claim 8 wherein said flanges of the connector components substantially surround a mating end of at least one of the components.

* * * * *